United States Patent [19]

Seiler

[11] Patent Number: 4,469,140

[45] Date of Patent: Sep. 4, 1984

[54] DOUBLE-LIFT OPEN-SHED JACQUARD LOOM

[75] Inventor: Wolfgang Seiler, Monchen-Gladbach, Fed. Rep. of Germany

[73] Assignee: Firma Oskar Schleicher, Monchen-Gladbach, Fed. Rep. of Germany

[21] Appl. No.: 362,258

[22] Filed: Mar. 26, 1982

[30] Foreign Application Priority Data

Apr. 3, 1981 [DE] Fed. Rep. of Germany ..... 3113434

[51] Int. Cl.[3] ..... D03C 1/08

[52] U.S. Cl. ..... 139/65; 139/59

[58] Field of Search ..... 139/59–65, 139/85

[56] References Cited

U.S. PATENT DOCUMENTS

| | | | |
|---|---|---|---|
| 539,753 | 5/1895 | Gledhill | 139/62 |
| 2,269,121 | 1/1942 | Miguora | 139/59 |
| 2,701,585 | 2/1955 | Dalle | 139/59 |
| 3,967,652 | 7/1976 | Seiler | 139/59 |
| 4,060,101 | 11/1977 | Seiler | 139/65 |

FOREIGN PATENT DOCUMENTS

| | | | |
|---|---|---|---|
| 463364 | 7/1928 | Fed. Rep. of Germany | 139/59 |
| 2535861 | 2/1977 | Fed. Rep. of Germany | 139/65 |
| 736546 | 9/1955 | United Kingdom | 139/61 |
| 986502 | 3/1965 | United Kingdom | 139/61 |

*Primary Examiner*—James Kee Chi

*Attorney, Agent, or Firm*—Sommer & Sommer

[57] ABSTRACT

A double-lift open-shed Jacquard loom comprises hooks controlled by control needles, the leg of each hook having three hook noses thereon. The loom also has two sets of blades which are movable in opposite directions towards and away from each other by lift means, and a stationary set of blades. The blades of at least one movable set are arranged pivotally about respective imaginary axes which extend in the longitudinal direction of each blades, and a pivoting means is provided for producing simultaneous parallel pivotal movement of the pivotal blades.

7 Claims, 5 Drawing Figures

DOUBLE-LIFT OPEN-SHED JACQUARD LOOM

BACKGROUND OF THE INVENTION

The present invention relates generally to a Jacquard machine and more particularly to a double-lift open-shed Jacquard machine.

One form of such a machine comprises a plurality of hooks which are controlled by control needles, with each hook having three noses or projections on a leg portion. The machine further comprises two sets of knives or blades which are movable in opposite directions towards or away from each other by lifting means, and a stationary set of arresting knives or blades.

In such a double-lift open-shed Jacquard machine, as described for example in U.S. Pat. No. 4,060,101 to the present applicant, the hooks are guided between an upper stationary hook rake and a lower stationary hook rake. In that arrangement, when the hooks are deflected, friction occurs between the hook and the upper hook rake.

A double-lift open-shed Jacquard machine has already been disclosed, for example in German Pat. No. 1,299,258, which does not have an upper hook rake. In that machine, a double-armed lever is pivotally mounted to the leg portion of the hook. However, it has been found that such a hook is very complicated and expensive, and those considerations have prevented it from making substantial inroads in practical use.

SUMMARY OF THE INVENTION

An object of the present invention is therefore to provide a new and improved Jacquard loom.

Another object of the present invention is to provide a double-lift open-shed Jacquard loom which requires only one hook rake, while ensuring reduced friction and simplicity of structure.

A further object of the present invention is to provide a double-lift open-shed Jacquard loom which includes means for preventing the hooks engaged on the respective movable blades from rising further in the event of stoppage of the machine, with the resultant possibility of defects in the article being produced.

In accordance with the present invention, these and other objects are achieved by a double-lift open-shed Jacquard loom comprising a plurality of hooks which are controlled by control needles, with each hook having three hook noses or projections on a leg portion of that hook. The loom further has two sets of blades or knives which are movable in opposite directions towards and away from each other by suitable lifting means, and also a stationary set of arresting blades. At least one set of movable blades are mounted for pivotal movement about respective axes extending in the longitudinal direction of the blades. A pivoting means is provided for producing simultaneous and parallel pivotal movement of the blades of the said set.

Preferably, it is the blades of the upper of the two sets of blades which are arranged to be pivotal in the above-mentioned manner.

By virtue of the blades being mounted for pivotal movement, the respective hooks which are suspended therefrom can be bent or laterally deflected by the pivotal movement of the blades whereby the lower hook nose moves outside the range of the rising blade. In contrast to previous forms of such a loom, wherein the upper hook rake serves as an abutment or support member when the hooks are subjected to a bending effect, the loom constructed in accordance with the principles of the present invention provides that the respective pivotal blade is used as an actuating lever arm such that, upon pivotal movement thereof, such a force is applied to the hook that the hook is bent away. Therefore, there is no need to provide an upper hook rake at the location of the pivotal blade assembly.

A further embodiment of the invention may provide that the hooks have cam or projection means at a spacing from the hook noses associated with the pivotal blades, said spacing corresponding at least to the dimensions of the pivotal blades in the longitudinal direction of the hook. The purpose of the cam means or projections is as follows: in the event of the loom suddenly stopping, the hooks have a tendency to continue to move further upwardly. In previous forms of such a loom, this tendency for upward movement on the part of the hooks has the result that the hooks jump off the blades on which they are being supported, and that causes defects in the article being produced when the machine starts up again. The cam means or projections which are provided in accordance with the principles of this invention, in this embodiment, prevent the hooks from jumping off the blades in that manner. The cam means or projections are desirably disposed at a distance from the hook noses which is somewhat greater than the distance corresponding to the dimensions of the pivotal blades in the longitudinal direction of the hooks, in order thereby to ensure that the blades are certain to pivot into position above the cam means, thereby to ensure that the cam means produce their proper function. The arrangement may also be such that the blades have projections or cam portions thereon, while the hooks have recesses or apertures of a configuration adapted to receive the cam portions or projections on the blades, thereby operatively to inter-engage the hooks and blades with each other to prevent the above-indicated tendency on the part of the hooks to continue moving upwardly when the machine is stopped.

Further features, objects and advantages of the present invention will be apparent from the description hereinafter of embodiments of the loom as illustrated in diagrammatic form in the drawing.

and

Figure 3:
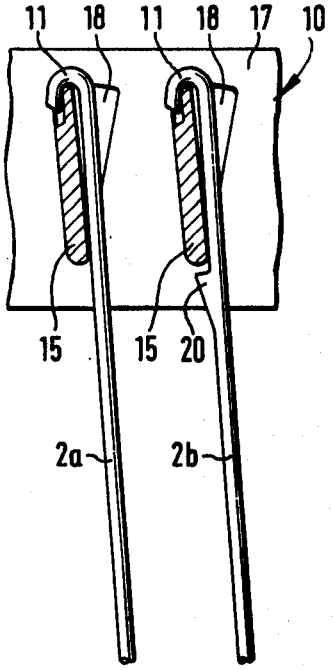
FIG. 3 shows a diagrammatic detailed view of the upper set of blades shown in FIG. 1, together with hooks, on an enlarged scale.
Figure 5:
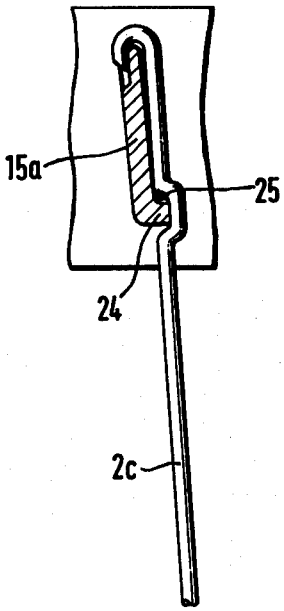

FIG. 5 shows a view corresponding to that shown in FIG. 3 but illustrating a further embodiment of the means for preventing the hooks from jumping off the blades in the event of a sudden stoppage of the machine.

DESCRIPTION OF THE PREFERRED EMBODIMENTS

Figure 1:
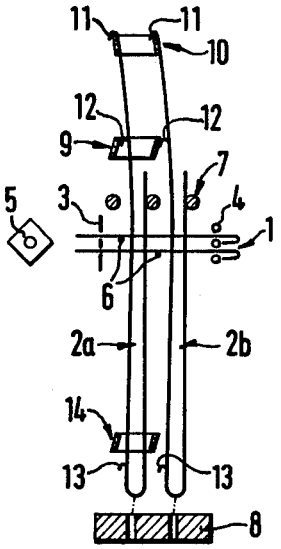
FIG. 1 is a diagrammatic view of a Jacquard loom, with only two control needles and two hooks being illustrated for the sake of clarity, the hooks being shown in the crossing position.
Figure 2:
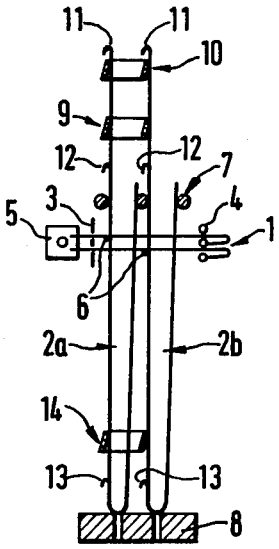
FIG. 2 is a view corresponding to FIG. 1 in an open-shed position, with the upper set of blades in its lower position and the lower set of blades in its upper position.

Referring firstly to FIGS. 1 and 2, shown therein are two control needles 1 and two hooks 2*a* and 2*b*. The control needles 1 are mounted in a needle board 3 and a needle rake 4. The control needles are controlled in the usual manner by means of a card prism or needle control mechanism diagrammatically indicated at 5. Pulses from the card prism 5 are transmitted to the hooks 2*a* and 2*b* by angular projections 6 which are disposed on the control needles 1. The hooks 2*a* and 2*b* are guided between a hook rake 7 and, in their rest position, are supported on a stationary hook bottom member 8.

Disposed above the hook rake 7 is a lower set of knives or blades, as indicated at 9, while above the lower set 9 of blades is an upper set 10 of knives or blades. The purpose of the sets 9 and 10 of blades is to carry hooks which have not been pressed away by the control needles 1 into the upper shed position or correspondingly actuated hooks into the lower shed position. For that purpose, each of the hooks has hook projections or noses 11 and 12 on a leg portion of the hook, with one nose 11 being disposed at the upper end of the hook (the nose 11 is more clearly visible, for example, in FIG. 3), while the other nose on the hook is disposed at a lower position thereon. In the upper shed position, the hooks 2*a* and 2*b* are supported with a further hook projection or nose 13 on a set 14 of arresting knives or blades which are disposed below the control needles 1.

The two sets 9 and 10 of blades are arranged so as to move in opposite directions towards and away from each other, but without crossing. The sets of blades each perform a rectilinear vertical movement towards and away from each other. In addition, each blade of at least one of the sets of movable blades, being blades 15 of the upper set 10 in the illustrated embodiments, is arranged for pivotal movement about an imaginary axis A (see FIG. 4) which extends in the longitudinal direction of the respective blades. The loom further includes a pivoting means 16 for producing simultaneous and parallel pivotal movement of the blades of the set 10.

Figure 4:
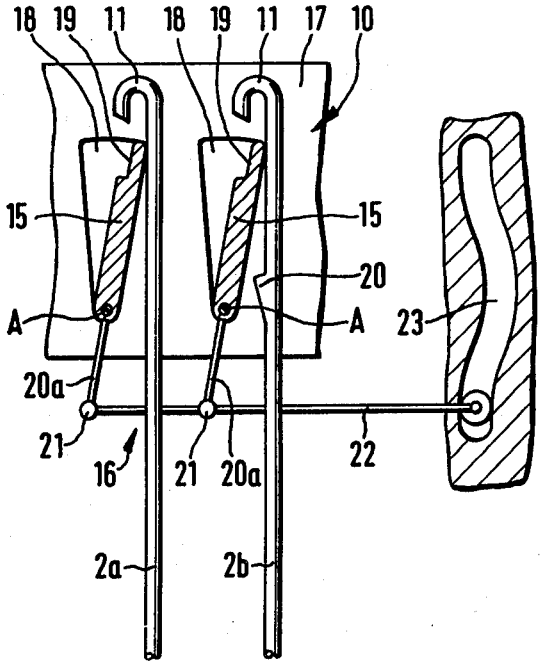
FIG. 4 shows a diagrammatic detailed view of the upper set of blades, as shown in FIG. 2, together with hooks, on an enlarged scale, and also with a diagrammatic view of the means for producing pivotal movement of the blades, over the lift region of the upper set of blades.

Dealing now in greater detail with the pivotal means 16, and referring also therefore to FIG. 3, the blade box or housing associated with the upper set 10 of blades has a frame member or structure as indicated at 17, in which there are provided apertures 18 of substantially triangular configuration. The blades 15 of the upper set 10 are pivotal in the apertures 18 between the position shown in FIG. 3 and the position shown in FIG. 4. For that purpose, each of the blades 15 carries a fixed projection 20*a* at its lower end, each said projection 20*a* being connected to a slide track 23 by way of a pivot 21 and an actuating rod 22. It will be noted from FIGS. 3 and 4 that the upper end portion of each blade 15 has a recess 19 corresponding to and adapted to cooperate with the end portion of the nose 11 of the associated hook. Upon lifting movement of the upper set 10 of blades by means of a lifting arrangement (not shown), the operational effect of the slide guide means 23 and the pivoting means 16 is to cause the blades 15 of the upper set 10 to pivot from the lower limit position of the upper blade set 10, as shown in FIG. 4, into the position shown in FIG. 3, when the arrangement has covered half the distance of the slide guide means 23. In the upper limit position of the blade set 10, the blades are then pivoted back into the initial position shown in FIG. 4, by virtue of the configuration of the slide guide means 23. Those hooks 2*a* and 2*b* which are engaged by the respective blades 15 are deflected or pivoted during the upward and downward movement of the upper set 10 of blades, as can be seen from FIG. 1. This deflection movement is such that the lower noses 12 on the hooks move past the blades of the lower set 9 of blades, and are therefore not engaged by the lower blades 9. The upper blades 15 are therefore used as a lever arm in such a way that, upon pivotal movement of the blades 15, such a force is applied to the hook carried thereon that the hook is bent away to such an extent that the respective other nose on the hook passes out of the path of engagement of the other set of blades.

Referring still to FIGS. 3 and 4, each hook may also carry a projection or cam member as shown at 20. In the illustrated embodiment, for the sake of improved clarity of the drawing, only the hook 2*b* is shown as carrying such a projection 20. It will be clearly seen from both FIGS. 3 and 4 that the projection 20 on the hook is arranged at a spacing from the hook nose 11, which corresponds at least to the dimension of the pivotal blade 15, as measured in the longitudinal direction of the respective hook. In practice, the space between the projection 20 and the hook nose 11 is somewhat larger than the above-mentioned dimension of the respective pivotal blade 15, so that there is an additional small space between the lower end of the blade 15 and the projection 20, in order to permit the hook nose 11 to be moved into a position of support on the blade 15, without hindrance. When the blade 15 is in the pivoted position as shown in FIG. 3, the projection 20 on each hook ensures that, in the event of the machine coming to an abrupt halt, the hook supported on the blade 15 cannot continue to move further upwardly so that the nose 11 of the respective hook could come away from the respective blade 15, which could result in defects in the article being produced on the loom when the loom is restarted.

Reference will now be made to FIG. 5, which shows another embodiment of the means for preventing the hooks from jumping off the blades in the event of an abrupt stoppage in operation of the machine. It will be appreciated that the embodiment shown in FIG. 5 operates in substantially the same manner as the embodiment shown in FIGS. 3 and 4 in regard to the action of the projection 20, insofar as the blade indicated at 15*a* in FIG. 5 has a projection portion or cam member 24 while the hook 2*c* has a recess 25 adapted to receive the cam portion 24 as clearly visible in FIG. 5, thereby to produce interengagement between the blade 15*a* and the hook 2*c*, in the same manner as the cooperation between the blade 15 and the projection 20 in FIGS. 3 and 4.

It will be appreciated that the constructions described above with reference to the drawing are only preferred embodiments of the invention, and that various other modifications and alterations may be made without thereby departing from the scope and spirit of the present invention.

What is claimed is:

1. A double-lift open-shed Jacquard loom comprising: a plurality of control needles; a plurality of hooks controlled by the control needles; first and second sets of blades which are vertically spaced from one another and which are movable in opposite directions towards and away from each other and which are adapted to engage respective ones of said hooks for causing selective movement thereof, each blade of at least one set being mounted pivotally about an imaginary axis extending in the longitudinal direction of said blades; lifting means for moving said first and second sets of blades in a vertical direction; and pivoting means for producing simultaneous parallel pivotal movement of said pivotal blades while said blades are being moved for bending any engaged hook.

2. A double-lift open-shed Jacquard loom as set forth in claim 1 wherein the blades of the upper set are mounted pivotally.

3. A double-lift open-shed Jacquard loom as set forth in claim 1 wherein each hook has a nose adapted to cooperate with an associated pivotal blade, and projection means mounted on said hook and spaced from said nose by a distance which correponds at least to the dimension of the associated blade as measured in the longitudinal direction of said hook.

4. A double-lift open-shed Jacquard loom as set forth in claim 1 wherein each hook has a projection means thereon and each blade has a recess therein, and wherein said hooks being adapted to be received in said recesses.

5. A double-lift open-shed Jacquard loom as set forth in claim 1 wherein each hook has a leg portion and a plurality of noses adapted to cooperate with an associated blade of said first and second sets.

6. A double-lift open-shed Jacquard loom as set forth in claim 1 and further including a stationary set of arresting blades cooperable with each hook.

7. A double-lift open-shed Jacquard loom as set forth in claim 6 wherein each hook has a leg portion carrying a plurality of noses adapted to cooperate with associated blades of each of said first, second and stationary sets.

* * * * *